US011069973B1

(12) United States Patent
Veysoglu et al.

(10) Patent No.: US 11,069,973 B1
(45) Date of Patent: Jul. 20, 2021

(54) MECHANICALLY STEERED ANTENNA WITH IMPROVED EFFICIENCY

(71) Applicant: Amazon Technologies, Inc., Seattle, WA (US)

(72) Inventors: Murat Veysoglu, Kirkland, WA (US); Ji-Fu Ma, Saratoga, CA (US); Jeffrey Weng, Woodinville, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/931,017

(22) Filed: May 13, 2020

(51) Int. Cl.
*H01Q 3/20* (2006.01)
*H01Q 19/19* (2006.01)
*H01Q 3/10* (2006.01)

(52) U.S. Cl.
CPC ..... *H01Q 3/20* (2013.01); *H01Q 3/10* (2013.01); *H01Q 19/192* (2013.01)

(58) Field of Classification Search
CPC ..... H01Q 3/20; H01Q 3/10; H01Q 19/192
USPC ..... 343/700 R
See application file for complete search history.

(56) References Cited

U.S. PATENT DOCUMENTS 189,538 A1 * 9/2004 Rao ..... H01Q 3/00 343/757
7,450,079 B1 * 11/2008 Baldauf ..... H01Q 13/00 343/781
8,159,410 B2 * 4/2012 Oliver ..... H01Q 13/00 343/882

FOREIGN PATENT DOCUMENTS

EP 0155761 A1 * 9/1985 ..... H01Q 19/18
EP 0631342 A1 * 12/1994 ..... H01Q 3/20

* cited by examiner

*Primary Examiner* — Graham P Smith
(74) *Attorney, Agent, or Firm* — Lowenstein Sandler LLP

(57) ABSTRACT

Technologies directed to a mechanically steered antenna with improved efficiency are described. One antenna includes a first reflector, a second reflector, and an antenna feed element. The second reflector is located on a reflecting side of the first reflector. The second reflector is offset from the first reflector. The second reflector receives an electromagnetic signal from the antenna feed element and outputs an inverted electromagnetic signal corresponding to the electromagnetic signal. The first reflector receives the inverted electromagnetic signal and outputs a collimated beam corresponding to the inverted electromagnetic signal. The antenna further includes a mechanism coupled to the first reflector. The mechanism rotates the first reflector about a first axis. The first axis is along a direction of the inverted electromagnetic signal.

23 Claims, 11 Drawing Sheets

MECHANICALLY STEERED ANTENNA WITH IMPROVED EFFICIENCY

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of the digital media items. In order to communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
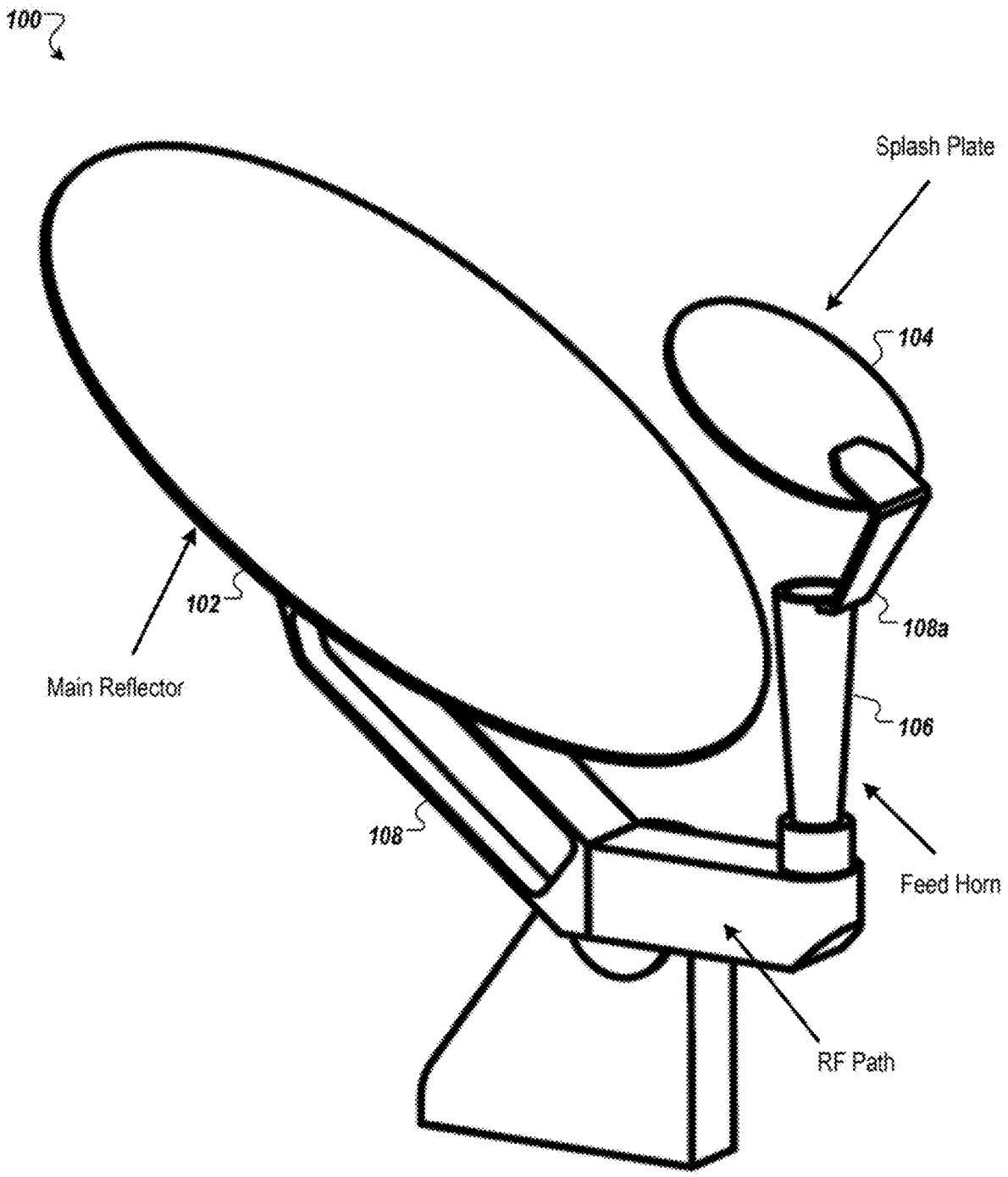
FIG. 1A is a schematic diagram of a reflector antenna with a parabolic reflector that is offset from a planar sub-reflector according to one embodiment.

Technologies directed to mechanically steering a reflector antenna are described. A reflector antenna is a device that can reflect electromagnetic waves. Conventional reflector antennas include front feed antennas, Cassegrain antennas, Gregorian antennas, and the like, and can be designed to reflect electromagnetic radiation as a directed beam. Reflector antennas, such as Cassegrain antennas and Gregorian antennas, include both a main (e.g., primary) reflector and a sub-reflector (e.g., a secondary reflector). An antenna feed provides an electromagnetic signal to the sub-reflector. The electromagnetic signal is reflected from the sub-reflector to the main reflector. The electromagnetic signal is reflected as a beam from the main reflector. The position of the sub-reflector and the antenna feed can affect an efficiency of the reflector antenna. In some cases, either one or both of the sub-reflector or the antenna feed can block a portion of the reflector antenna aperture and degrade the efficiency. In some cases, the position of the sub-reflector and/or the antenna feed can lead to beam squint effects in which there is a dispersion between left circularly polarized electromagnetic radiation and right circularly polarized radiation. Beam squint can degrade the efficiency of the transmission of the beam from the main reflector. Further, in order to steer the beam, the reflector antenna typically includes a first rotary joint that is coupled to the main reflector and a second rotary joint that is coupled to the reflector antenna itself. The two rotary joints allow the beam to be steered while acting as a waveguide to direct the electromagnetic signal. The electromagnetic signal passes through both rotary joints. The rotary joints can be expensive and complex to manufacture, and may be prone to failures due to their complexity.

Aspects of the present disclosure overcome the deficiencies of conventional reflector antennas by providing a reflector antenna with an offset parabolic main reflector. The reflector antenna can include a support structure. A parabolic reflector and a planar reflector can be coupled to the support structure. The parabolic reflector can be the main reflector and the planar reflector can be the sub-reflector (e.g., a splash plate). The parabolic reflector can be offset from the planar reflector. In other words, the planar reflector can be positioned to be off-center from a paraboloid axis of the parabolic reflector. A feed horn can be in proximity of the sub-reflector in order to provide and/or receive signals to or from the planar reflector. The feed horn can be the antenna feed. Alternatively, other types of antenna feed elements can be used other than a feed horn. Aspects of the present disclosure overcome the deficiencies of conventional reflector antennas by minimizing aperture blocking by the planar reflector and the feed horn. Aspects of the present disclosure overcome the deficiencies of conventional reflector antennas by using a planar sub-reflector and a parabolic main reflector that are mutually offset to eliminate beam squint effects.

Aspects of the present disclosure overcome the deficiencies of conventional reflector antennas by providing a mechanical-based steering mechanism. A first gimbal mechanism can be coupled to the parabolic reflector. The first gimbal mechanism can be coupled behind the parabolic reflector so as to not block any portion of the aperture of the parabolic reflector. The first gimbal mechanism allows for the rotation of the parabolic reflector independently from the support structure, the planar reflector, and the feed horn. The first gimbal mechanism allows the parabolic reflector to be rotated about a first axis. The reflector antenna can include a second gimbal mechanism coupled to the parabolic reflector, the planar reflector, and the feed horn. The second gimbal mechanism allows for the rotation of the parabolic reflector, the planar reflector, and the feed horn as a single unit about a second axis. Because of the configuration of the parabolic reflector and the planar reflector, the first gimbal mechanism does not include a rotary joint or other mechanism through which an RF signal needs to pass and a rotary joint or other mechanism can just be used in the second gimbal mechanism.

During operation, the feed horn can convert first electromagnetic signals (such as a radio frequency (RF) signal, an optical signal, a microwave signal, and the like) from a transmitter into first electromagnetic waves. The feed horn can feed the first electromagnetic waves to the planar reflector as a first conical beam extending from the feed horn to the planar reflector. The planar reflector can reflect the first conical beam as a second conical beam extending from the planar reflector to the parabolic reflector. The parabolic reflector can reflect the second conical beam as a collimated beam in a direction that is parallel to the paraboloid axis. The paraboloid axis is an axis of symmetry of the paraboloid shape of the parabolic reflector. Additionally or alternatively, the feed horn can convert second electromagnetic waves that are received via the planar reflector to second electromagnetic signals for a receiver. In another embodiment, the feed horn generates an RF signal. The planar sub-reflector receives the RF signal as a first conical beam from the feed horn and outputs an inverted RF signal as a second conical beam. The inverted RF signal corresponds to the RF signal. The parabolic reflector receives the inverted RF signal and outputs a collimated beam along the paraboloid axis. The collimated beam corresponds to the inverted RF signal. The first gimbal mechanism can allow the parabolic reflector to be rotated about (or around) a feed firing axis. The feed firing axis is the line that the second conical beam follows from the planar reflector to the parabolic reflector. In one embodiment, the feed firing axis is an axis of symmetry of the second conical beam. The first axis can be scanned by rotating the parabolic reflector around the feed firing axis. The second gimbal mechanism can allows the array assembly (that includes the parabolic reflector, the planar reflector, the feed horn, and additional structures to position each component) to rotate as a single unit to scan the second axis. By scanning the parabolic reflector about the first axis and scanning the array assembly about the second axis, the reflector antenna can steer the beam in any direction within a half-space (e.g., the space on one side of a plane) that includes the parabolic reflector, the planar sub-reflector, and the feed horn. In one embodiment, the second gimbal mechanism is disposed on a plane that is parallel to the ground and the half-space corresponds to the space above the plane (e.g., the space that includes the first gimbal mechanism). In some embodiments, the parabolic reflector and the planar sub-reflector can be mirror reflectors or otherwise constructed from aluminum, anodized aluminum, steel, or other reflective material.

FIG. 1A is a schematic diagram of a reflector antenna 100 with a parabolic reflector 102 that is offset from a planar sub-reflector 104 according to one embodiment. The reflector antenna 100 is a mechanically-steered antenna system. The reflector antenna 100 includes a support structure 108. The parabolic reflector 102 is coupled to the support structure 108. A feed horn 106 is coupled to the support structure 108. The feed horn 106 is located next to the planar sub-reflector 104.

The feed horn 106 generates an electromagnetic signal from a transmitter (not depicted in FIG. 1A) and feeds the electromagnetic signal to the planar sub-reflector 104. The planar sub-reflector 104 receives the electromagnetic signal from the feed horn 106 and reflects an inverted electromagnetic signal to the parabolic reflector 102. The electromagnetic signal is inverted due to the planar nature (e.g., an infinite radius of curvature) of the planar sub-reflector 104. The planar sub-reflector 104 receives the electromagnetic signal at a first angle from a normal to its surface and reflects the inverted electromagnetic signal at a second angle from a normal to its surface. The second angle and the first angle have the same values but are in opposite directions from the normal. The parabolic reflector 102 receives the inverted electromagnetic signal and reflects the inverted electromagnetic signal as a collimated beam (e.g., such as a spot beam or a pencil beam). The parabolic reflector 102 reflects the inverted electromagnetic signal as a collimated beam due to its parabolic properties. Because the parabolic reflector 102 collimates the beam for beam steering applications, the parabolic reflector 102 is the main reflector of the reflector antenna 100. Similarly, because the planar sub-reflector directs the electromagnetic signal to the parabolic reflector 102 (the main reflector), the planar sub-reflector 104 is the sub-reflector of the reflector antenna 100.

In one embodiment, the feed horn 106 feeds the electromagnetic signal to the planar sub-reflector 104 as a first conical beam extending from the feed horn 106 to the planar sub-reflector 104. The planar sub-reflector 104 reflects the inverted electromagnetic signal to the parabolic reflector 102 as a second conical beam extending from the planar sub-reflector 104 to the parabolic reflector 102. A feed firing axis (not depicted in FIG. 1A) refers to the line that the inverted electromagnetic signal follows from the planar sub-reflector 104 to the parabolic reflector 102.

In another embodiment, the planar sub-reflector 104 receives the electromagnetic signal from the feed horn 106 and outputs an inverted electromagnetic signal. The parabolic reflector 102 receives the inverted electromagnetic signal and outputs a collimated beam corresponding to the inverted electromagnetic signal.

In another embodiment, the feed horn 106 receives an electromagnetic signal from the planar sub-reflector 104. In this case, the parabolic reflector 102 receives a second electromagnetic signal and reflects the second electromagnetic signal to the planar sub-reflector 104. The planar sub-reflector 104 receives the second electromagnetic signal from the parabolic reflector 102 and reflects a second inverted electromagnetic signal to the feed horn 106. The feed horn 106 receives the second inverted electromagnetic signal for a receiver. Additionally or alternatively, the parabolic reflector 102 receives a second electromagnetic signal (e.g., from an external source). The parabolic reflector 102 outputs a third electromagnetic signal corresponding to the second electromagnetic signal. The planar sub-reflector 104 receives the third electromagnetic signal and outputs a second inverted electromagnetic signal. The planar sub-reflector 104 outputs the second inverted electromagnetic signal. The second inverted electromagnetic signal corresponds to the third electromagnetic signal. A path of the second electromagnetic signal and the second inverted electromagnetic signal does not include a first gimbal mechanism (e.g., as described with respect to FIG. 1B) that rotates the reflector antenna 100 about (or around) a first axis.

The planar sub-reflector 104 is designed to be smaller than the parabolic reflector 102. As depicted in FIG. 1, the planar sub-reflector 104 is circular, and a diameter of the planar sub-reflector 104 is less than a diameter of the parabolic reflector 102 (e.g., measured across a rim of the parabolic reflector). In other embodiments, the planar sub-reflector 104 can have a different shape, such as a square or an oval. In such embodiments, a dimension of the planar sub-reflector 104 is less than the diameter of the parabolic reflector 102. A ratio of a focal length of the parabolic reflector 102 to the diameter of the parabolic reflector 102 can be set to be greater than 0.5. In one embodiment, setting the ratio to be 0.62 can minimize beam squint effects of the collimated beam. An efficiency of the reflector antenna 100 can be improved by setting an appropriate ratio. In one embodiment, setting the ratio to be 0.62 can maximize the efficiency of the reflector antenna 100.

The planar sub-reflector 104 is located on a reflecting side of the parabolic reflector 102. In one embodiment, the planar sub-reflector 104 is offset from a paraboloid axis of the parabolic reflector 102. The paraboloid axis is an optical axis of the parabolic reflector. In another embodiment, the parabolic reflector 102 is offset from the planar sub-reflector 104. In other words, the planar sub-reflector 104 is not located on the paraboloid axis of the parabolic reflector 102. The paraboloid axis is an axis of symmetry of the paraboloid shape of the parabolic reflector 102. By offsetting the planar sub-reflector 104 from the paraboloid axis of the parabolic reflector 102, the planar sub-reflector 104 can be positioned outside (or substantially outside) of the aperture of the reflecting antenna 100. By minimizing the amount of the aperture is blocked, the efficiency of the reflecting antenna 100 can be increased.

The feed horn 106 is located in proximity to the planar sub-reflector 104. The planar sub-reflector can be fixed to the feed horn 106 by a portion 108*a* of the support structure 108. The feed horn 106 is oriented to point at the planar sub-reflector 104 such that the electromagnetic signal that the feed horn 106 feeds to the planar sub-reflector 104 is incident on the planar sub-reflector 104 at the first angle from the normal. The position and orientation of the feed horn 106 is fixed with respect to the position and orientation of the planar sub-reflector 104. In other embodiments, the feed horn 106 can be another type of antenna feed element, such as a patch antenna, a slotted waveguide antenna, a helical antenna (normal mode or axial mode), or the like. In another embodiment, antenna feed element is a multi-element feed.

Figure 1B:
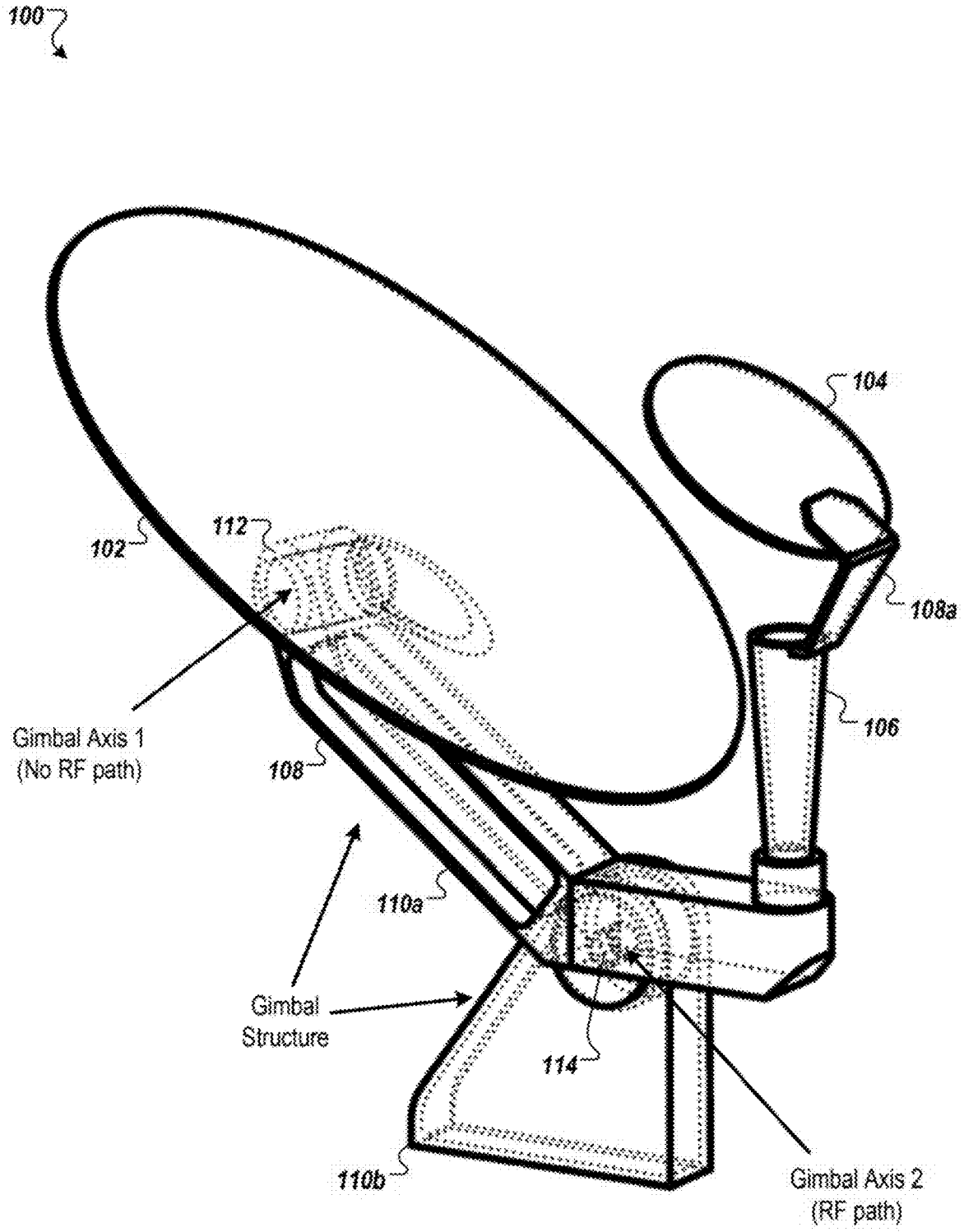
FIG. 1B is a schematic diagram of a reflector antenna with a first gimbal mechanism and a second gimbal mechanism according to one embodiment.

FIG. 1B is a schematic diagram of a reflector antenna 100 with a first gimbal mechanism 112 and a second gimbal mechanism 114 according to one embodiment. The first gimbal mechanism 112 is coupled to the parabolic reflector 102. The second gimbal mechanism 114 is coupled to the parabolic reflector 102, the planar sub-reflector 104, and the feed horn 106 via the support structure 108. The support structure 108 is part of a gimbal structure 110*a* and 110*b* that includes the second gimbal mechanism 114.

The first gimbal mechanism 112 allows the parabolic reflector 102 to rotate about a first axis (i.e., the feed firing axis as described with respect to FIG. 1A) to steer the collimated beam along the first axis. The first gimbal mechanism 112 has no path for the electromagnetic signal or the second electromagnetic signal to travel and does not include a rotary joint.

The second gimbal mechanism 114 allows the reflector antenna 100 to rotate about a second axis. In one embodiment, the second gimbal mechanism 114 can rotate the reflector antenna 100 about the second axis to compensate for the rotate of the reflector antenna 100 about the first axis by the first gimbal mechanism 112. In one embodiment, a first part of the gimbal structure 110*a* is coupled to the parabolic reflector 102, the planar sub-reflector 104, and the feed horn 106 and the second gimbal mechanism 114 allows the first part of the gimbal structure 110*a* to rotate as a single unit with respect to the second part of the gimbal structure 110*b*. In another embodiment, the support structure 108 is coupled to the parabolic reflector 102, the planar sub-reflector 104, and the feed horn 106 and the second gimbal mechanism 114 allows the support structure 108 to rotate with respect to the second part of the gimbal structure 110*b*. The second gimbal mechanism 114 includes a rotary joint (not illustrated in FIG. 1A as it is internal to the structure) through which the electromagnetic signal and the second electromagnetic signal pass. In one embodiment, the rotary joint is an electro-mechanical component used to transmit electromagnetic signals between a stationary part of a system (such as the gimbal structure 110*b*) and a moveable part of the system (such as the gimbal structure 110*a*). The rotary joint can be a coaxial rotary joint, a waveguide rotary joint, a waveguide-to-coaxial rotary joint, or the like. The rotary joint is part of a transmit and/or receive path for the electromagnetic signal and the second electromagnetic signal. In one embodiment, the second gimbal mechanism 114 receives the second electromagnetic signal from the feed horn 106. In another embodiment, the rotary joint receives the second electromagnetic signal from the feed horn 106. In another embodiment, the rotary joint of the second gimbal mechanism is in a signal path of a transmitted signal (e.g., the electromagnetic signal) and in the signal path of a received signal (e.g., the second electromagnetic signal), and the first gimbal mechanism is not part of the path.

The first gimbal mechanism 112 and the second gimbal mechanism 114 allow the reflector antenna to have two rotational degrees of freedom (e.g., about the first axis and the second axis respectively). One degree of freedom can adjust an azimuthal angle of the collimated beam and another degree of freedom can adjust an elevation angle of the collimated beam. By rotating the parabolic reflector 102, the planar sub-reflector 104, and the feed horn 106 as a single unit (via the second gimbal mechanism 114) and the parabolic reflector independently (via the first gimbal mechanism 112), the collimated beam can be directed at any point in a half-space. The half-space refers to a space on one side of a plane. In one embodiment, the half-space can be the space above a plane which is parallel and offset from the ground. In one embodiment, the half-space is the space above a plane which is parallel to the ground and at the height of the second gimbal mechanism 114. In another embodiment, the half-space includes the first gimbal mechanism 114 and the second gimbal mechanism. In another embodiment, the reflector antenna (except for the second part of the gimbal structure 110*b*) are disposed on a plane, and the half-space is the space above the plane. In one embodiment, the first gimbal mechanism 112 and the second gimbal mechanism 114 steer the collimated beam in any direction from the ground to space.

In one embodiment, the first gimbal mechanism 112 rotates the parabolic reflector about the first axis to steer the collimated beam in a first degree of freedom and the second gimbal mechanism 114 rotates the parabolic reflector 102, the planar sub-reflector 104, and the feed horn 106 as a single unit about the second axis to steer the collimated beam in a second degree of freedom that is different than the first degree of freedom. In another embodiment, the first gimbal mechanism 112 rotates the parabolic reflector 102 by a first rotational angle to steer the collimated beam and the second gimbal mechanism 114 rotates the parabolic reflector 102, the planar sub-reflector 104, and the feed horn 106 by a second rotational angle that is different than the first rotational angle to steer the collimated beam. In a further embodiment, the first rotational angle is an azimuthal angle and the second rotational axis is an elevation angle. In other embodiments, the first rotational angle can be a combination of the azimuthal angle and the elevation angle and the second rotational angle can be another combination of the azimuthal angle and the elevation angle. In other embodiments, the first rotational angle is an azimuthal angle and the second rotational axis is an altitude angle. In other embodiments, the first rotational angle can be a combination of the azimuthal angle and the altitude angle and the second rotational angle can be another combination of the azimuthal angle and the altitude angle.

It should be noted that although the parabolic reflector 102 (e.g., the main reflector of the reflector antenna 100) is depicted in FIGS. 1A-1B as a parabolic reflector, in other embodiments, the main reflector can be another type of reflector, such as a spherical reflector, other types of concave (e.g., converging) reflectors, a planar reflector, or the like. Similarly, although the planar sub-reflector 104 (e.g., the sub-reflector of the reflector antenna 100) is depicted in FIGS. 1A-1B as a planar sub-reflector, in other embodiments, the sub-reflector can be another type of reflector, such as a spherical reflector, a parabolic reflector, or another type of concave reflector.

It should be noted that although FIGS. 1A-1B are depicted with gimbal mechanisms 112 and 114 for beam steering, in other embodiments, other steering mechanisms can be used for one or both of the gimbal mechanisms 112 and 114. Other steering mechanisms can include rotary joints or any mechanically rotating joints (e.g., ball-bearing joints, sleeve-bearing joints, bushing joints, flexible wiring, or the like). For example, in one embodiment, the parabolic reflector 102 can be rotated via the first gimbal mechanism 112 about the first axis while the parabolic reflector 102, the planar sub-reflector 104, and the feed horn 106 can be rotated about the second axis by a rotary joint.

Although the reflector antenna 100 is depicted in FIGS. 1A-1B as having a main reflector (e.g., the parabolic reflector 102) and a sub-reflector (e.g., the planar sub-reflector 104), in another embodiment, the reflector antenna can include just a main reflector. In such an embodiment, the feed horn can be rotated to point directly at the main reflector. In such an embodiment, the main reflector can be a different type of concave reflector (e.g., other than a parabolic reflector). It should be noted that in some cases, a parabolic reflector, such as the parabolic reflector 102, may have minor deviations from having a perfect paraboloid shape to generate a particular shape beam.

Figure 2:
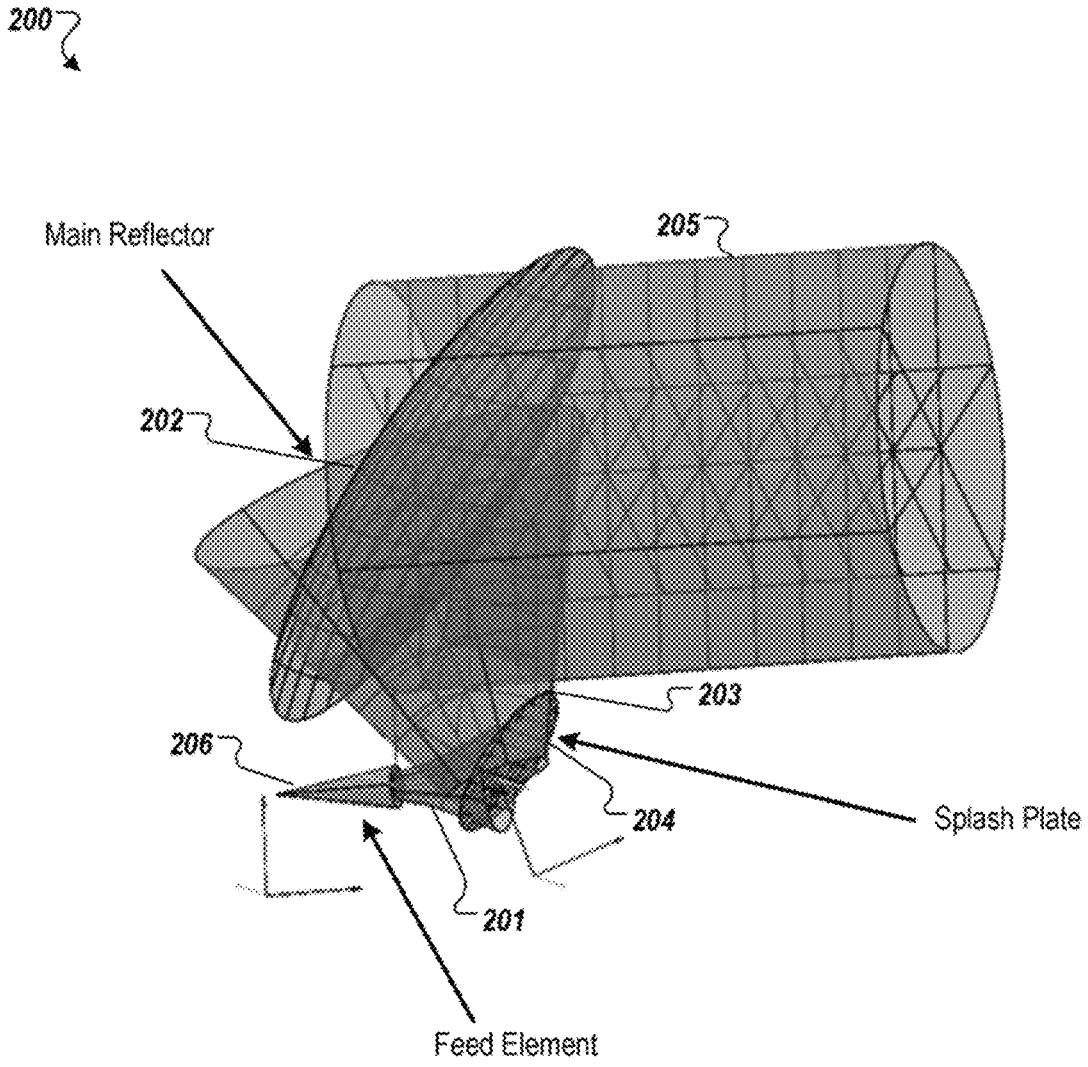
FIG. 2 is a schematic functional diagram of a reflector antenna and an electromagnetic signal as a first conical beam, a second conical beam, and a collimated beam according to one embodiment.

FIG. 2 is a schematic functional diagram of a reflector antenna 200 and an electromagnetic signal as a first conical beam 201, a second conical beam 203, and a collimated beam 205 according to one embodiment. Although not all components of the reflector antenna 200 are shown, the reflector antenna 200 is similar to the reflector antenna 100 of FIGS. 1A-1B as noted by similar reference numbers. Although not depicted in FIG. 2, a support structure is coupled to the parabolic reflector 202, the planar sub-reflector 204, and the feed horn 206. The support structure ensures that the position and orientation of the feed horn 206 is fixed with respect to the position and orientation of the planar sub-reflector 204. In one embodiment, the feed horn 206 converts first RF signals from a transmitter (not depicted in FIG. 2) to first radio waves and feeds the first radio waves to the planar sub-reflector 204. The first radio waves are fed as a first conical beam 201 extending from the feed horn 206 to the planar sub-reflector 204. The planar sub-reflector 204 reflects the first conical beam 201 as a second conical beam 203 that extends from the planar sub-reflector 204 to the parabolic reflector 202. An axis (e.g., an axis of symmetry) of the second conical beam 203 is referred to as the feed firing axis. The parabolic reflector 202 reflects the second conical beam as a collimated beam 205 directed along a paraboloid axis of the parabolic reflector 202. As described with respect to FIG. 1B, the collimated beam 205 can be steered via a first gimbal mechanism (not shown in FIG. 2) coupled to the parabolic reflector 202 allowing the parabolic reflector 202 to be rotated about the feed firing axis and a second gimbal mechanism (not shown in FIG. 2) coupled to the parabolic reflector 202, the planar sub-reflector 204, and the feed horn 206, allowing the parabolic reflector 202, the planar sub-reflector 204, and the feed horn 206 to be rotated about a second axis as a single unit.

In another embodiment, the planar sub-reflector 204 receives an electromagnetic signal (e.g., a radio wave) from the antenna feed element and outputs an inverted electromagnetic signal. The inverted electromagnetic signal corresponds to the electromagnetic signal. The parabolic reflector 202 receives the inverted electromagnetic signal and outputs a collimated beam. The collimated beam corresponds to the inverted electromagnetic signal.

The first conical beam 201 is emitted from the feed horn 206 as a first conical frustum with a first smaller radius at the feed horn 206 and a first larger radius at the planar sub-reflector 204. Similarly, because the planar sub-reflector 204 intercepts the first conical beam 201, and reflects it as the second conical beam 203, the second conical beam 203 is a second conical frustum with a second smaller radius at the planar sub-reflector 204 and a second larger radius at the parabolic reflector 202. Due to the planar nature of the planar sub-reflector 204, the second smaller radius is equal to the first larger radius and the second conical beam 203 is inverted with respect to (e.g., is a mirror image of) the first conical beam 201.

Although the reflecting antenna 200 is depicted as transmitting a signal in FIG. 2, in another embodiment, the reflecting antenna 200 can also receive a signal. The signal arrives as electromagnetic waves received by the parabolic reflector 202. The parabolic reflector 202 focuses the electromagnetic waves at a focal point of the parabolic reflector 202. At least a portion of the electromagnetic waves is received by the planar sub-reflector 204. The planar sub-reflector 204 reflects the portion of the electromagnetic waves to the feed horn 206. The feed horn 206 converts the portion of electromagnetic waves to electromagnetic signals for a receiver.

Figure 3:
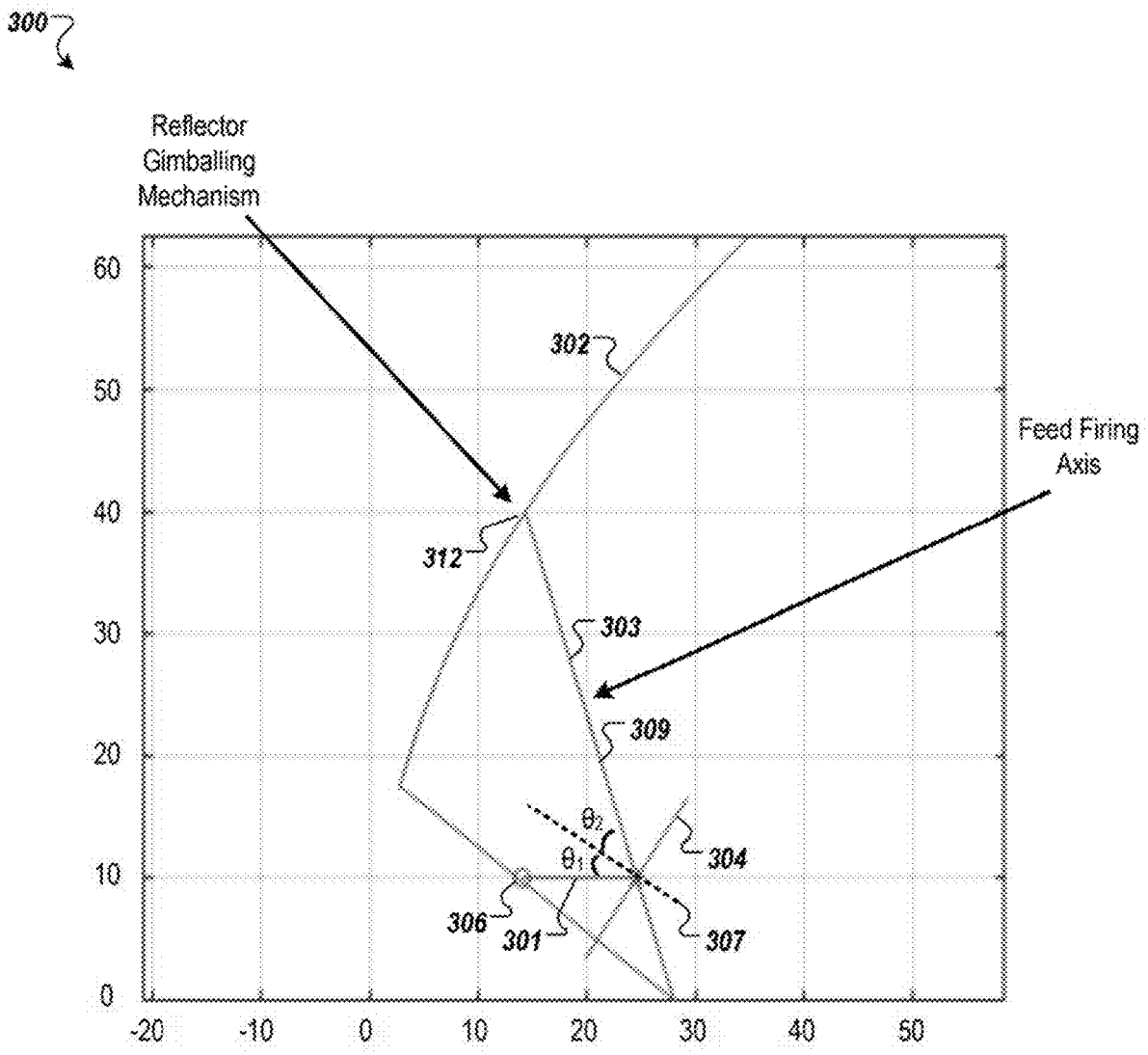
FIG. 3 is a geometric diagram of a reflecting antenna according to one embodiment.

FIG. 3 is a geometric diagram of a reflecting antenna 300 according to one embodiment. Although not all components of the reflector antenna 300 are shown, the reflector antenna 300 is similar to the reflector antenna 100 of FIGS. 1A-1B and the reflector antenna 200 of FIG. 2 as noted by similar reference numbers. FIG. 3 is a line representation of a parabolic reflector 302 and a planar sub-reflector 304. FIG. 3 is a point representation of a feed horn 306 and a first gimbal mechanism 312. FIG. 3 is a ray representation of a first conical beam 301 of an electromagnetic signal and a second conical beam 303 of the electromagnetic signal. The feed horn 306 provides a first conical beam 301 to the planar sub-reflector 304. The first conical beam 301 is incident on the planar sub-reflector 304 at a first angle (01) measured from a normal 307 (e.g., perpendicular) to a surface of the planar sub-reflector 304. The planar sub-reflector 304 reflects the first conical beam 301 as a second conical beam 303 to the parabolic reflector 302. The second conical beam is reflected from the planar sub-reflector 304 at a second angle (02) from the normal 307. The second angle is the same angle as the first angle. A line followed by the second conical beam 303 defines a feed firing axis 309. In one embodiment, the feed firing axis 309 is an axis of symmetry of the second conical beam 303. The first gimbal mechanism 312 is coupled to and disposed behind the parabolic reflector 302. The first gimbal mechanism 312 allows the parabolic reflector 302 to rotate about the feed firing axis.

Figure 4A:
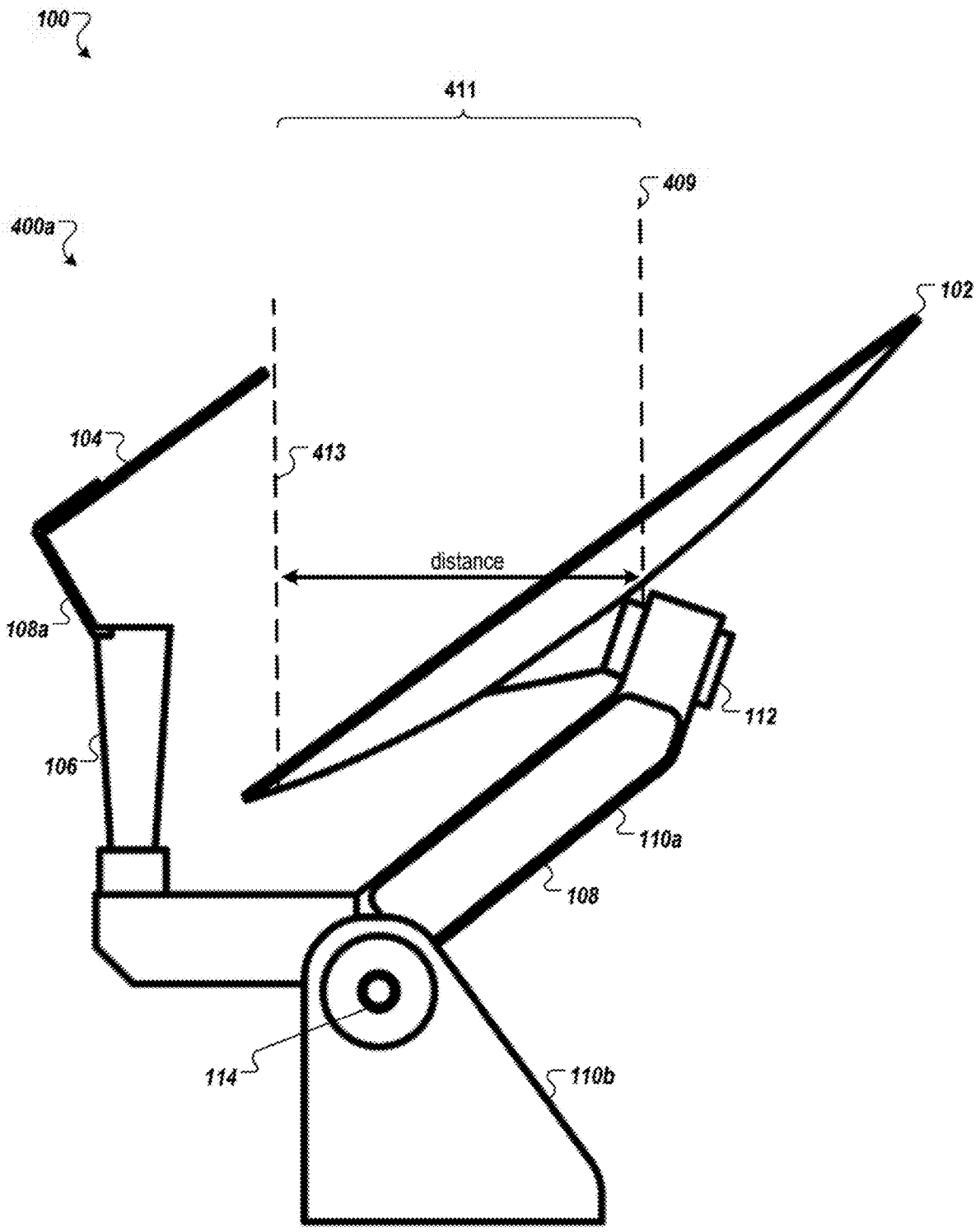
FIG. 4A is a schematic diagram of a side view of the reflector antenna of FIGS. 1A-1B showing the paraboloid axis according to one embodiment.

FIG. 4A is a schematic diagram of a side view 400*a* of the reflector antenna 100 of FIGS. 1A-1B showing the paraboloid axis 409 according to one embodiment. The planar sub-reflector 104 is located on a reflecting side of the parabolic reflector 102. In one embodiment, a center 413 of the planar sub-reflector 104 is offset from a paraboloid axis 409 of the parabolic reflector 102 by a distance 411. In another embodiment, the paraboloid axis 409 of the parabolic reflector 102 is offset from the center 413 of the planar sub-reflector 104 by the distance 411. In other words, the center 413 of the planar sub-reflector 104 is not located on the paraboloid axis 409 of the parabolic reflector 102. The paraboloid axis 409 is an axis of symmetry of the paraboloid shape of the parabolic reflector 102. By offsetting the planar sub-reflector 104 from the paraboloid axis 409 of the parabolic reflector 102, the planar sub-reflector 104 can be positioned outside (or substantially outside) of the aperture of the reflecting antenna 100. In one embodiment, the offset is determined such that the aperture of the parabolic reflector 102 of the reflecting antenna is not blocked by the planar sub-reflector 104. By minimizing the amount of the aperture is blocked, the efficiency of the reflecting antenna 100 can be increased.

Figure 4B:
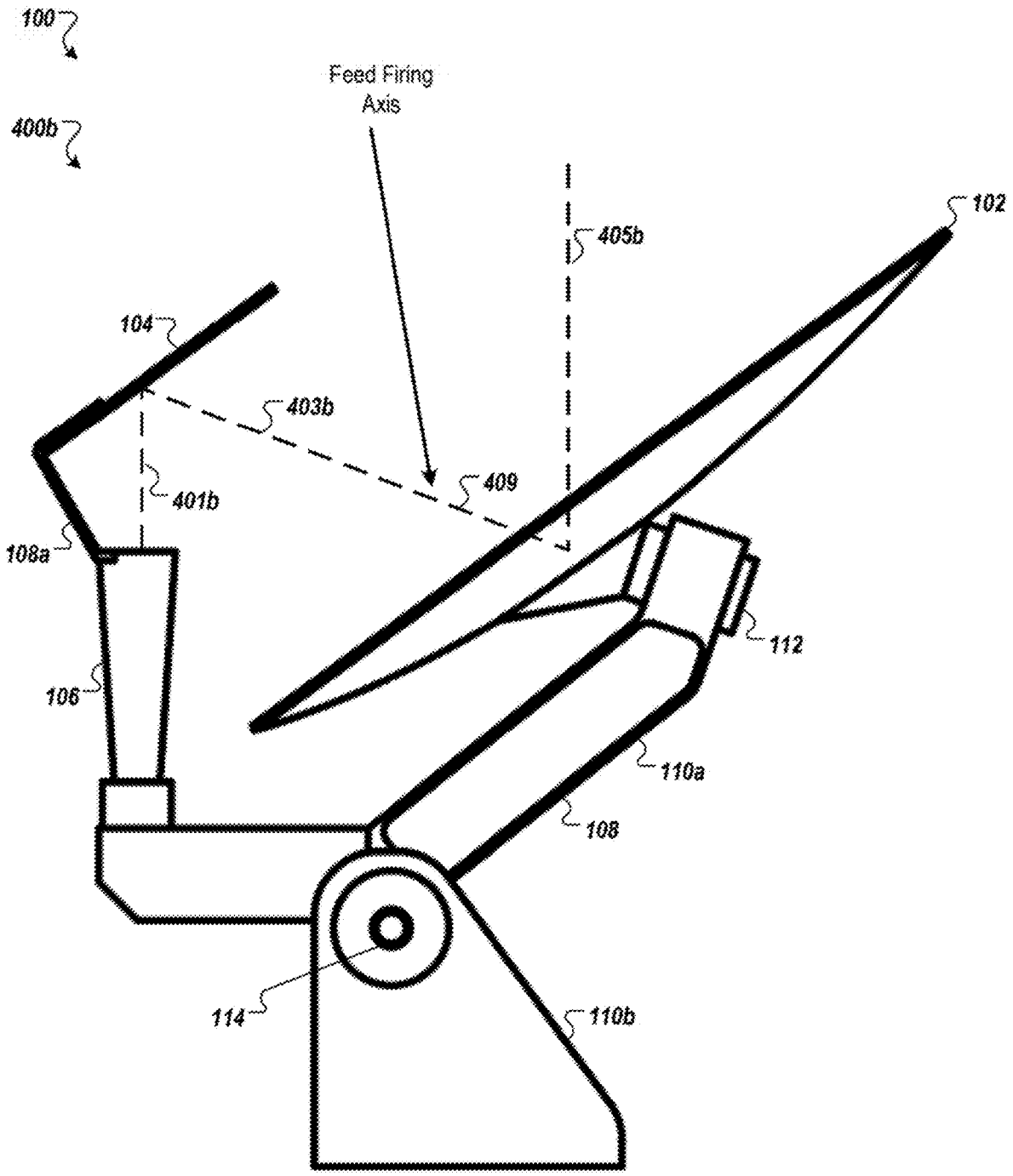
FIG. 4B is a schematic diagram of a side view of the reflector antenna of FIGS. 1A-1B and a signal path according to one embodiment.

FIG. 4B is a schematic diagram of a side view 400*b* of the reflector antenna 100 of FIGS. 1A-1B and a signal path according to one embodiment. A signal (such as an electromagnetic signal, an electromagnetic wave, first RF signals, first radio waves, and the like) follows the path indicated by the dashed line in FIG. 4B. In one embodiment, the reflector antenna transmits an RF signal. The feed horn 106 converts a first RF signal from a transmitter (not depicted in FIG. 4B) to a first radio wave and feeds the first radio wave to the planar sub-reflector 104. The first radio wave follows a path 401*b* from the feed horn 106 to the planar sub-reflector 104. The first radio wave is fed as a first conical beam extending from the feed horn 106 to the planar sub-reflector 104. The planar sub-reflector 104 reflects the first radio wave along a second path 403 from the planar sub-reflector 104 to the parabolic reflector 102. The first radio wave between the planar sub-reflector 104 and the parabolic reflector 102 is a second conical beam that extends from the planar sub-reflector 104 to the parabolic reflector 102. The path 403*b* followed by the second conical beam is the feed firing axis. The feed firing axis is the paraboloid axis 409. The paraboloid 409 is an axis of symmetry of the second conical beam. The parabolic reflector 102 reflects the first radio wave as a collimated beam directed along a path 405*b* that is a paraboloid axis of the parabolic reflector 102. The collimated beam (along the path 405*b*) can be steered via the first gimbal mechanism 112 and the second gimbal mechanism 114. The first gimbal mechanism 112 is coupled to the parabolic reflector 102 which allows the parabolic reflector 102 to be rotated about the feed firing axis (e.g., the paraboloid axis 409). The second gimbal mechanism 114 is coupled to the parabolic reflector 102, the planar sub-reflector 104, and the feed horn 106, allowing the parabolic reflector 102, the planar sub-reflector 104, and the feed horn 106 to be rotated about a second axis as a single unit. In one embodiment, the second gimbal mechanism 114 is coupled to the support structure 108 which is part of the gimbal structure 110*a* and 110*b* and the parabolic reflector 102, the planar sub-reflector 104, and the feed horn 106 are coupled to the support structure 108. In another embodiment, the second gimbal mechanism 114 is coupled to the first gimbal structure 110*a* and the parabolic reflector 102, the planar sub-reflector 104, and the feed horn 106 are coupled to the first gimbal structure 110*a*.

In the embodiment depicted in FIG. 4B, the reflector antenna 100 is oriented to steer a signal beam (e.g., such as the collimated beam as described herein) along the path 405*b* that is vertically upwards. It should be noted that the paths 401*b*, 403*b*, and 405*b* are for illustrative purposes and may not be drawn to include all features or angles to scale.

Figure 4C:
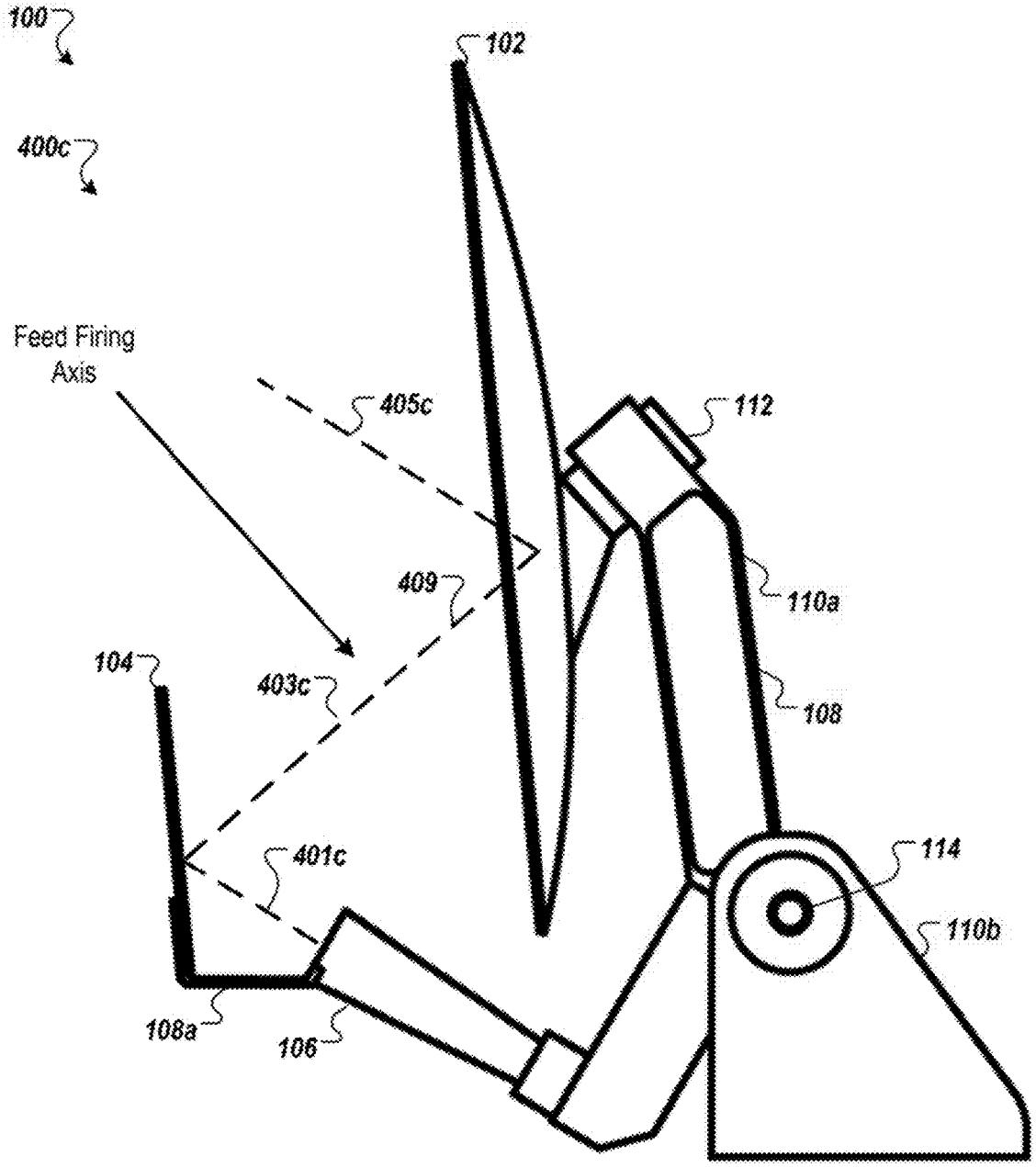
FIG. 4C is a schematic diagram of a side view of the reflector antenna of FIGS. 1A-1B and a signal path according to one embodiment.

FIG. 4C is a schematic diagram of a side view 400*c* of the reflector antenna 100 of FIGS. 1A-1B and a signal path according to one embodiment. The signal follows the path indicated by the dashed line in FIG. 4C. The signal is transmitted from the feed horn to the planar sub-reflector 104 along path 401*c*. The signal is reflected from the planar sub-reflector 104 to the parabolic reflector 102 along path 403*c*. The parabolic reflector reflects the signal as a collimated beam along path 405*c*. The path 405*c* is in a counterclockwise direction from the vertical (e.g., the path 405*b* of FIG. 4B). The view 400*c* of the reflector antenna 100 differs from the view 400*b* due to a rotation (e.g., by 60 degrees counterclockwise from the vertical) of the reflector antenna 100 by the second gimbal mechanism 114. It should be noted that the paths 401*c*, 403*c*, and 405*c* are for illustrative purposes and may not be drawn to include all features or angles to scale.

Figure 4D:
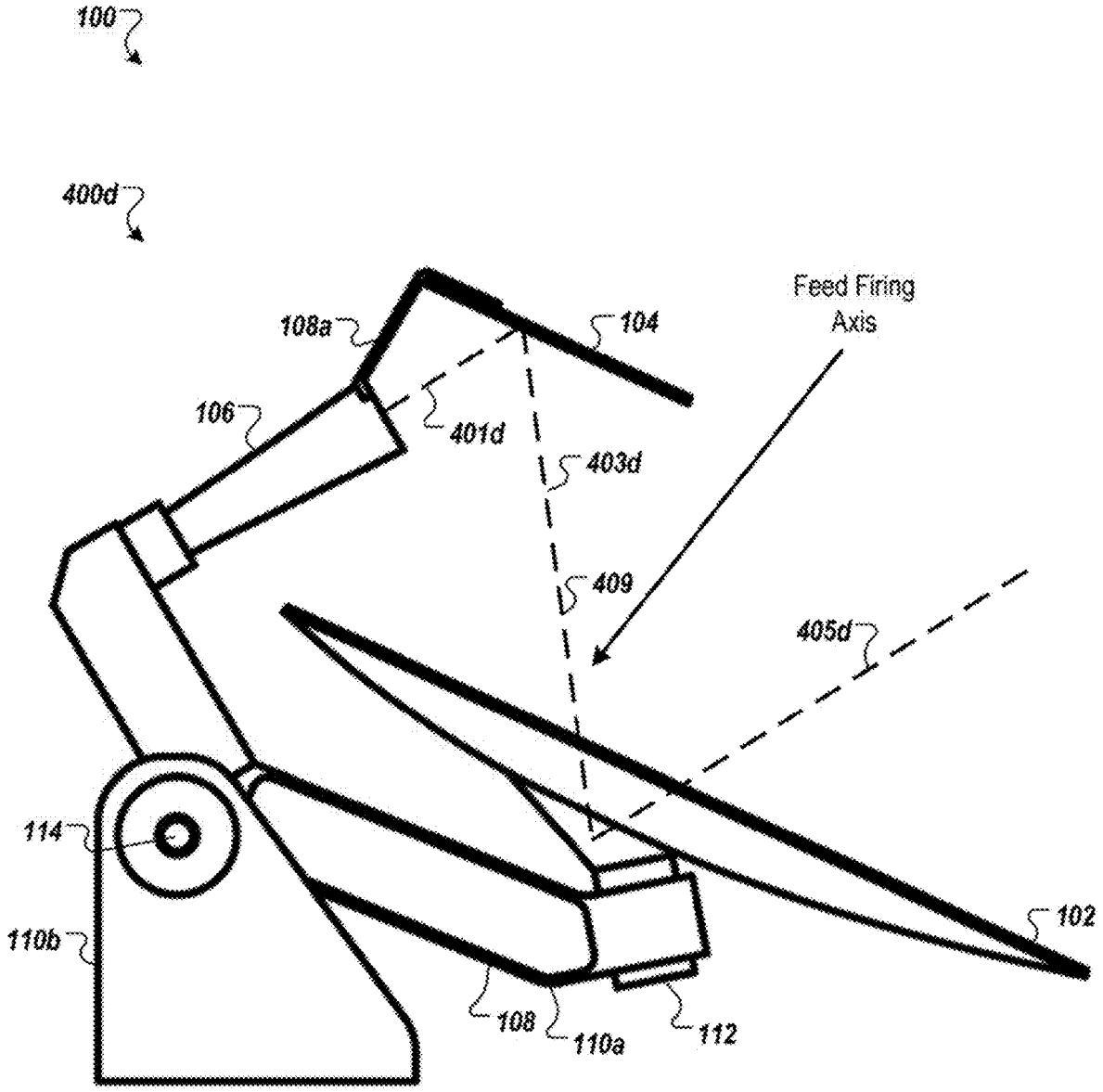
FIG. 4D is a schematic diagram of a side view of the reflector antenna of FIGS. 1A-1B and a signal path according to one embodiment.

FIG. 4D is a schematic diagram of a side view 400*d* of the reflector antenna 100 of FIGS. 1A-1B and a signal path according to one embodiment. The signal follows the path indicated by the dashed line in FIG. 4D. The signal is transmitted from the feed horn to the planar sub-reflector 104 along path 401*d*. The signal is reflected from the planar sub-reflector 104 to the parabolic reflector 102 along path 403*d*. The parabolic reflector reflects the signal as a collimated beam along path 405*d*. The path 405*d* is in a clockwise direction from the vertical (e.g., the path 405*b* of FIG. 4B). The view 400*d* of the reflector antenna 100 differs from the view 400*b* due to a rotation (e.g., by 60 degrees clockwise from the vertical) of the reflector antenna 100 by the second gimbal mechanism 114. It should be noted that the paths 401*d*, 403*d*, and 405*d* are for illustrative purposes and may not be drawn to include all features or angles to scale.

Figure 4E:
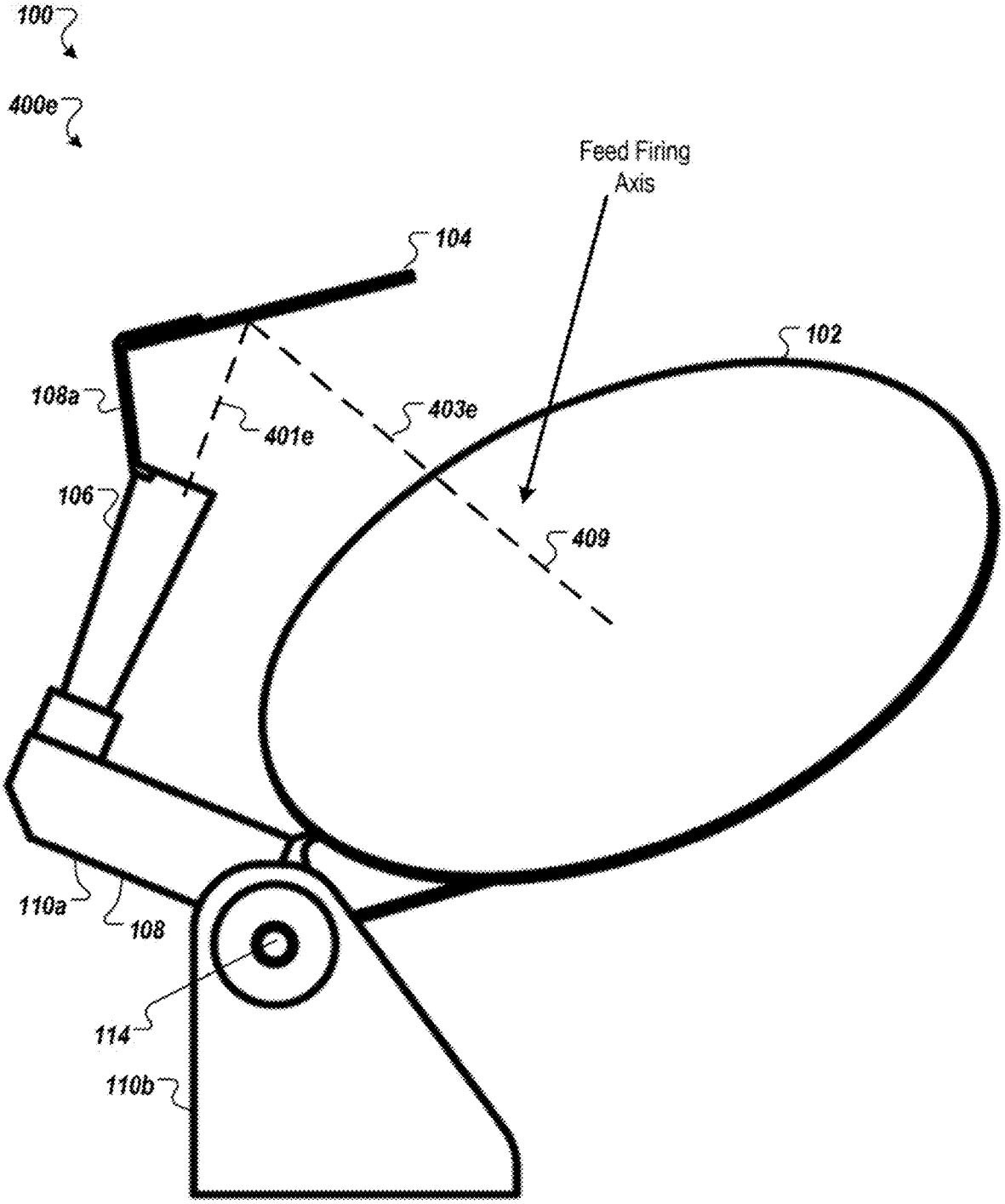
FIG. 4E is a schematic diagram of a side view of the reflector antenna of FIGS. 1A-1B and a signal path according to one embodiment.

FIG. 4E is a schematic diagram of a side view 400*e* of the reflector antenna 100 of FIGS. 1A-1B and a signal path according to one embodiment. The signal follows the path indicated by the dashed line in FIG. 4E. The signal is transmitted from the feed horn to the planar sub-reflector 104 along path 401*e*. The signal is reflected from the planar sub-reflector 104 to the parabolic reflector 102 along path 403*e*. The parabolic reflector reflects the signal as a collimated beam along a path that points out of the page and is not depicted in FIG. 4E. The view 400*e* of the reflector antenna 100 differs from the view 400*b* due to a rotation (e.g., by 60 degrees out of the page with respect to the view 400*b*) of the reflector antenna 100 by the first gimbal mechanism 112 (not shown in FIG. 4E). It should be noted that the paths 401*e* and 403*e* are for illustrative purposes and may not be drawn to include all features or angles to scale.

Figure 4F:
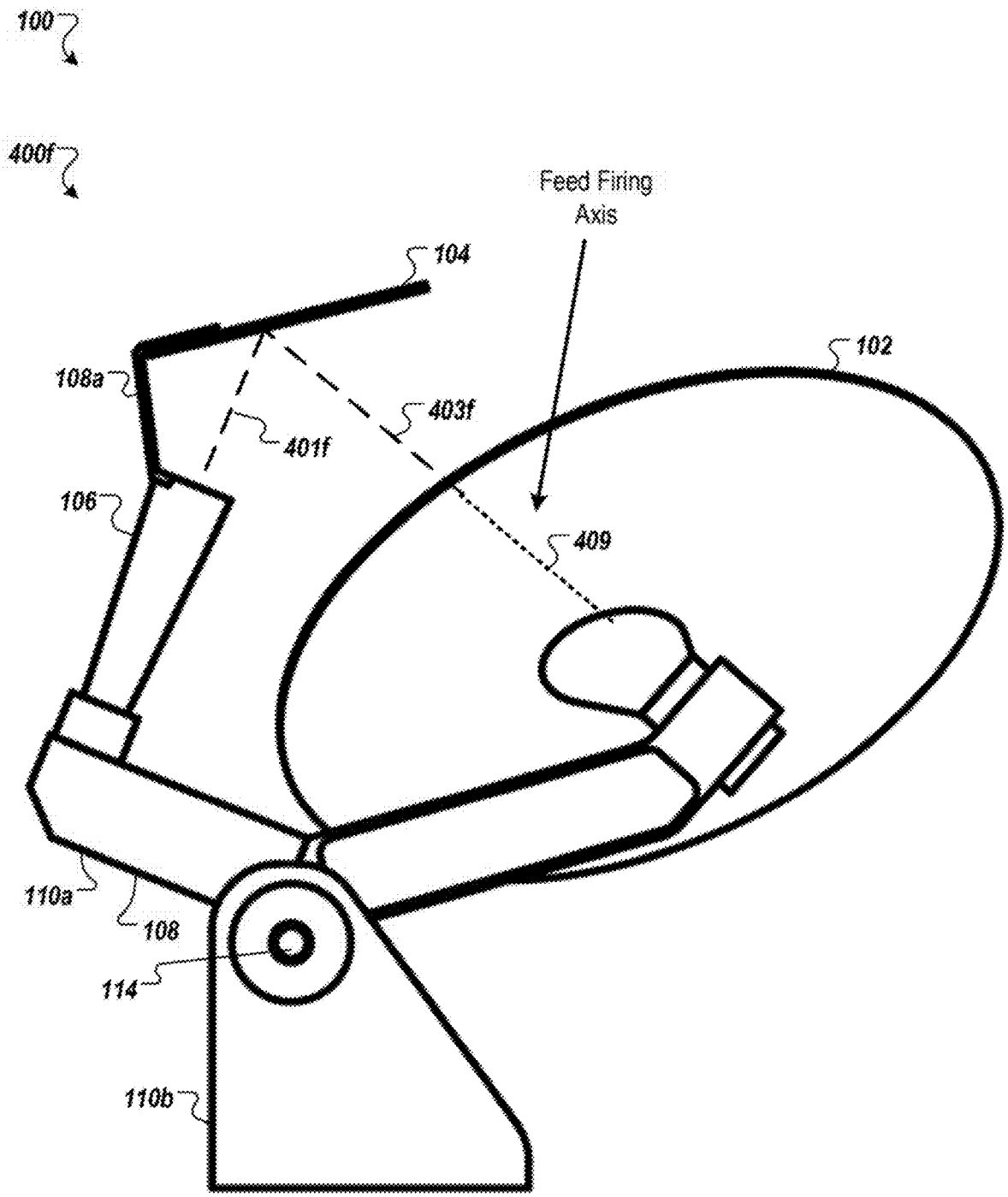
FIG. 4F is a schematic diagram of a side view of the reflector antenna of FIGS. 1A-1B and a signal path according to one embodiment.

FIG. 4F is a schematic diagram of a side view 400*f* of the reflector antenna 100 of FIGS. 1A-1B and a signal path according to one embodiment. The signal follows the path indicated by the dashed line in FIG. 4F. The signal is transmitted from the feed horn to the planar sub-reflector 104 along path 401*f*. The signal is reflected from the planar sub-reflector 104 to the parabolic reflector 102 along path 403*f*. The parabolic reflector reflects the signal as a collimated beam along a path that points into the page and is not depicted in FIG. 4F. The view 400*f* of the reflector antenna 100 differs from the view 400*b* due to a rotation (e.g., by 60 degrees into the page with respect to the view 400*b*) of the reflector antenna 100 by the first gimbal mechanism 112. It should be noted that the paths 401*f* and 403*f* are for illustrative purposes and may not be drawn to include all features or angles to scale.

Figure 5:
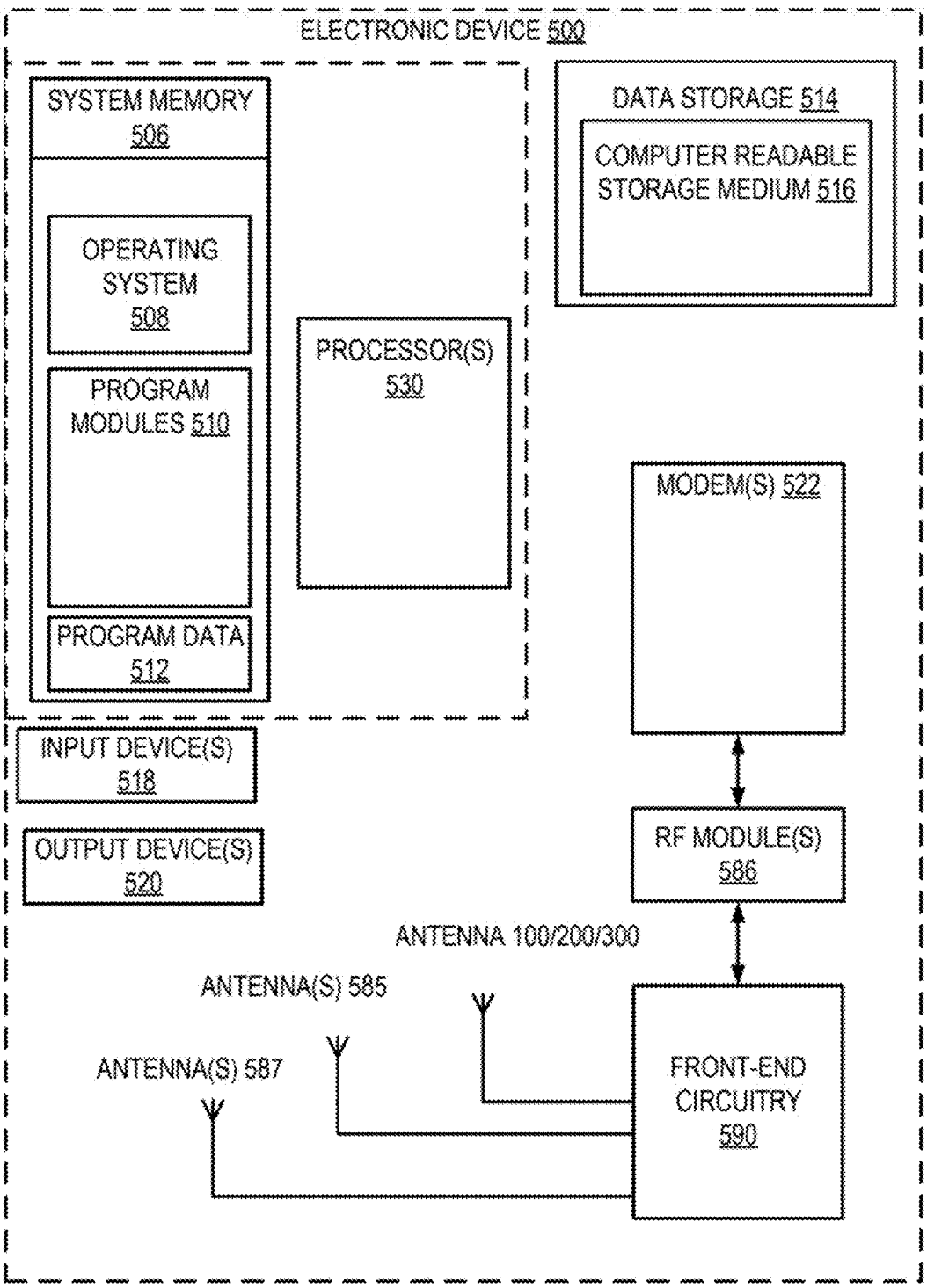
FIG. 5 is a block diagram of an electronic device that includes a reflector antenna as described herein according to one embodiment.

FIG. 5 is a block diagram of an electronic device 500 that includes a reflector antenna as described herein according to one embodiment. In one embodiment, the electronic device 500 includes the reflector antenna 100 of FIGS. 1A-1B and FIGS. 4A-4F. In another embodiment, the electronic device 500 includes the reflector antenna 200 of FIG. 2. In another embodiment, the electronic device 500 includes the reflector antenna 300 of FIG. 3. Alternatively, the electronic device 500 may be other electronic devices, as described herein.

The electronic device 500 includes one or more processor(s) 530, such as one or more CPUs, microcontrollers, field programmable gate arrays, or other types of processors. The electronic device 500 also includes system memory 506, which may correspond to any combination of volatile and/or non-volatile storage mechanisms. The system memory 506 stores information that provides operating system component 508, various program modules 510, program data 512, and/or other components. In one embodiment, the system memory 506 stores instructions of methods to control operation of the electronic device 500. The electronic device 500 performs functions by using the processor(s) 530 to execute instructions provided by the system memory 506.

The electronic device 500 also includes a data storage device 514 that may be composed of one or more types of removable storage and/or one or more types of non-removable storage. The data storage device 514 includes a computer-readable storage medium 516 on which is stored one or more sets of instructions embodying any of the methodologies or functions described herein. Instructions for the program modules 510 may reside, completely or at least partially, within the computer-readable storage medium 516, system memory 506 and/or within the processor(s) 530 during execution thereof by the electronic device 500, the system memory 506, and the processor(s) 530 also constituting computer-readable media. The electronic device 500 may also include one or more input devices 518 (keyboard, mouse device, specialized selection keys, etc.) and one or more output devices 520 (displays, printers, audio output mechanisms, etc.).

The electronic device 500 further includes a modem 522 to allow the electronic device 500 to communicate via a wireless connections (e.g., such as provided by the wireless communication system) with other computing devices, such as remote computers, an item providing system, and so forth. The modem 522 can be connected to one or more RF modules 586. The RF modules 586 may be a wireless local area network (WLAN) module, a wide area network (WAN) module, wireless personal area network (WPAN) module, Global Positioning System (GPS) module, or the like. The antenna structures (antenna(s) 585, 587, 100/200/300) are coupled to the front-end circuitry 590, which is coupled to the modem 522. The front-end circuitry 590 may include radio front-end circuitry, antenna switching circuitry, impedance matching circuitry, or the like. The antennas 585, 587, 100/200/300 may be GPS antennas, Near-Field Communication (NFC) antennas, other WAN antennas, WLAN or PAN antennas, or the like. The modem 522 allows the electronic device 500 to handle both voice and non-voice communications (such as communications for text messages, multimedia messages, media downloads, web browsing, etc.) with a wireless communication system. The modem 522 may provide network connectivity using any type of mobile network technology including, for example, Cellular Digital Packet Data (CDPD), General Packet Radio Service (GPRS), EDGE, Universal Mobile Telecommunications System (UMTS), Single-Carrier Radio Transmission Technology (1×RTT), Evaluation Data Optimized (EVDO), High-Speed Down-Link Packet Access (HSDPA), Wi-Fi®, Long Term Evolution (LTE) and LTE Advanced (sometimes generally referred to as 4G), etc.

The modem 522 may generate signals and send these signals to antenna(s) 585, 587, 100/200/300 of a first type (e.g., 20 GHz), antenna(s) 585 of a second type (e.g., 30 GHz), and/or antenna(s) 587 of a third type (e.g., WAN, WLAN, PAN, or the like), via front-end circuitry 590, and RF module(s) 586 as descried herein. Antennas 585, 587, 100/200/300 may be configured to transmit in different frequency bands and/or using different wireless communication protocols. The antennas 585, 587, 100/200/300 may be directional, omnidirectional, or non-directional antennas. In addition to sending data, antennas 585, 587, 100/200/300 may also receive data, which is sent to appropriate RF modules connected to the antennas. One of the antennas 585, 587, 100/200/300 may be any combination of the antenna structures described herein.

In one embodiment, the electronic device 500 establishes a first connection using a first wireless communication protocol, and a second connection using a different wireless communication protocol. The first wireless connection and second wireless connection may be active concurrently, for example, if an electronic device is receiving a media item from another electronic device via the first connection) and transferring a file to another electronic device (e.g., via the second connection) at the same time. Alternatively, the two connections may be active concurrently during wireless communications with multiple devices. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna structure and the second wireless connection is associated with a second antenna.

Though a modem 522 is shown to control transmission and reception via antenna (585, 587, 100/200/300), the electronic device 500 may alternatively include multiple modems, each of which is configured to transmit/receive data via a different antenna and/or wireless transmission protocol.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "causing," "determining," "adjusting," "measuring," setting," "storing," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A mechanically-steered antenna system comprising:

a support structure;

a parabolic reflector coupled to the support structure;

a planar sub-reflector coupled to the support structure and located on a reflecting side of the parabolic reflector and offset from a paraboloid axis of the parabolic reflector, the parabolic reflector having a paraboloid shape, and the paraboloid axis being an axis of symmetry of the paraboloid shape;

a feed horn coupled to the support structure, wherein:

the planar sub-reflector receives a radio frequency (RF) signal as a first conical beam from the feed horn and outputs an inverted RF signal as a second conical beam, the inverted RF signal corresponding to the RF signal;

the parabolic reflector receives the inverted RF signal and outputs a collimated beam along the paraboloid axis, the collimated beam corresponding to the inverted RF signal; and the feed horn receives a second RF signal via the planar sub-reflector; and a first gimbal mechanism coupled to the parabolic reflector, wherein the first gimbal mechanism rotates the parabolic reflector about a first axis to adjust at least an azimuthal angle of the collimated beam, the first axis being an axis of symmetry of the second conical beam between the parabolic reflector and the planar sub-reflector.

2. The mechanically-steered antenna system of claim 1, further comprising a second gimbal mechanism coupled to the parabolic reflector, the feed horn, and the planar sub-reflector, wherein the second gimbal mechanism rotates the parabolic reflector, the feed horn, and the planar sub-reflector as a single unit about a second axis to adjust an elevation angle of the collimated beam, wherein the second gimbal mechanism comprises a rotary joint that is part of a path of the RF signal and the second RF signal, and wherein the first gimbal mechanism is not part of the path.

3. An apparatus comprising:

a first reflector;

an antenna feed element;

a second reflector located on a reflecting side of the first reflector and offset from the first reflector, the second reflector receives an electromagnetic signal from the antenna feed element and outputs an inverted electromagnetic signal corresponding to the electromagnetic signal, wherein the first reflector receives the inverted electromagnetic signal directly from the second reflector, and outputs a collimated beam corresponding to the inverted electromagnetic signal; and a mechanism coupled to the first reflector, the mechanism rotates the first reflector about a first axis, the first axis being along a direction of the inverted electromagnetic signal between the second reflector and the first reflector.

4. The apparatus of claim 3, wherein the first reflector is a parabolic reflector, and wherein the second reflector is a planar reflector, and wherein the antenna feed element is a feed horn.

5. The apparatus of claim 4, wherein a ratio of a focal length of the first reflector to a diameter of the first reflector is greater than 0.5.

6. The apparatus of claim 3, wherein the antenna feed element is a multi-element feed.

7. The apparatus of claim 3, further comprising a second mechanism configured to rotate the first reflector, the antenna feed element, the second reflector, and the mechanism about a second axis, the second axis being different than the first axis.

8. The apparatus of claim 7, wherein the antenna feed element is configured to receive a second electromagnetic signal via the second reflector, and wherein the second mechanism receives the second electromagnetic signal from the antenna feed element.

9. The apparatus of claim 3, wherein the mechanism rotates the first reflector by a first angle to steer the collimated beam and a second mechanism rotates first reflector, the second reflector, and the antenna feed as a single unit by a second angle to steer the collimated beam, the second angle being different than the first angle.

10. The apparatus of claim 9, wherein the first angle is an azimuthal angle and the second angle is an elevation angle.

11. The apparatus of claim 3, wherein:

the first reflector is configured to receive a second electromagnetic signal and output a third electromagnetic signal to the second reflector, the third electromagnetic signal corresponding to the second electromagnetic signal;

the second reflector is configured to receive the third electromagnetic signal and output a second inverted electromagnetic signal to the antenna feed element, the second inverted electromagnetic signal corresponding to the third electromagnetic signal; and a path of the second inverted electromagnetic signal does not include the mechanism.

12. The apparatus of claim 3, wherein the apparatus is disposed on a first plane and the mechanism and a second mechanism are configured to direct the collimated beam in a half-space above the first plane, the half-space comprising the mechanism and the second mechanism, and wherein the second mechanism is configured to rotate the first reflector, the antenna feed element, and the second reflector as a single unit about a second axis.

13. The apparatus of claim 3, wherein the second reflector is fixed with respect to the antenna feed element.

14. The apparatus of claim 3, wherein a diameter of the second reflector is less than a diameter of the first reflector.

15. A reflecting antenna comprising:

a support structure;

a first reflector coupled to the support structure;

a second reflector coupled to the support structure, the second reflector having a diameter which is less than a diameter of the first reflector, and the second reflector being offset from the first reflector;

a feed element coupled to the support structure and disposed in proximity to the second reflector, the feed element to provide a first signal to the second reflector, and the second reflector to provide an inverted signal directly to the first reflector;

a first mechanism coupled to the first reflector, the first mechanism being configured to rotate the first reflector about a first axis, the first axis being along a direction of the inverted signal between the first reflector and the second reflector; and a second mechanism coupled to the support structure, the second mechanism being configured to rotate the support structure about a second axis.

16. The reflecting antenna of claim 15, wherein:

the feed element is configured to provide the first signal from a transmitter to the second reflector as a first conical beam;

the second reflector is configured to output the inverted signal corresponding to the first signal;

the first reflector is configured to output a collimated beam along an optical axis of the first reflector, the collimated beam corresponding to the inverted signal; and the feed element is further configured to receive a second signal via the second reflector.

17. The reflecting antenna of claim 16, wherein the first axis is along a direction of the inverted signal from the second reflector to the first reflector.

18. The reflecting antenna of claim 16, wherein the first mechanism comprises a first gimbal mechanism and the second mechanism comprises a second gimbal mechanism, wherein the second mechanism is part of a path of the first signal and the second signal, and wherein the first mechanism is not part of the path.

19. The reflecting antenna of claim 15, wherein the first reflector is a parabolic reflector, wherein the second reflector is a planar reflector, and wherein the feed element is a feed horn.

20. The reflecting antenna of claim 15, wherein the second mechanism is disposed on a first plane and the first mechanism and the second mechanism are configured to direct the first signal in a half-space above the first plane, the half-space comprising the first mechanism.

21. The mechanically-steered antenna system of claim 1, wherein the first axis is an axis of rotation of the parabolic reflector, the axis of rotation being different from the paraboloid axis of the parabolic reflector.

22. The apparatus of claim 3, wherein the first axis is an axis of rotation of the first reflector, the axis of rotation being different from an axis of symmetry of the first reflector.

23. The reflecting antenna of claim 15, wherein the first axis is an axis of rotation of the first reflector, the axis of rotation being different from an axis of symmetry of the first reflector.

* * * * *